US008990980B1

(12) United States Patent
Hindley

(10) Patent No.: US 8,990,980 B1
(45) Date of Patent: Mar. 31, 2015

(54) PILLOWCASE WITH INTEGRAL SECONDARY HOOD STRUCTURE

(71) Applicant: Christopher Hindley, Florence, NJ (US)

(72) Inventor: Christopher Hindley, Florence, NJ (US)

( * ) Notice: Subject to any disclaimer, the term of this patent is extended or adjusted under 35 U.S.C. 154(b) by 0 days.

(21) Appl. No.: 13/947,018

(22) Filed: Jul. 19, 2013

Related U.S. Application Data

(60) Provisional application No. 61/673,808, filed on Jul. 20, 2012.

(51) Int. Cl.
*A47G 9/10* (2006.01)
*A61G 99/00* (2006.01)

(52) U.S. Cl.
CPC ..... *A61G 99/00* (2013.01)
USPC ..... 5/490; 5/485; 5/639; 5/644; 5/636; 2/69.5; 2/202

(58) Field of Classification Search
USPC ..... 5/490, 644, 636, 639, 494; 2/69.5, 202
See application file for complete search history.

(56) References Cited

U.S. PATENT DOCUMENTS

| | | | | |
|---|---|---|---|---|
| 2,413,828 | A * | 1/1947 | Hirsh et al. | 5/485 |
| D270,320 | S | 8/1983 | Smith | |
| 6,363,554 | B1 * | 4/2002 | Brown | 5/490 |
| 7,657,954 | B1 * | 2/2010 | Bunkers | 5/644 |
| D685,161 | S * | 7/2013 | Sun | D2/866 |
| 2005/0283910 | A1 * | 12/2005 | DuQue | 5/482 |
| 2013/0125312 | A1 * | 5/2013 | Harooni | 5/639 |
| 2013/0227784 | A1 * | 9/2013 | Holliday et al. | 5/490 |
| 2013/0312180 | A1 * | 11/2013 | Moran | 5/490 |

* cited by examiner

*Primary Examiner* — Peter M Cuomo
*Assistant Examiner* — Brittany Wilson
(74) *Attorney, Agent, or Firm* — LaMorte & Associates P.C.

(57) ABSTRACT

A pillow assembly that utilizes a hood to inhibit certain movements of the head. The pillow assembly utilizes a pillowcase having a top surface and a bottom surface. The pillowcase can be stuffed to become a pillow or can be used to cover a preexisting pillow. A hood structure is sewn onto the pillowcase. The hood structure is sewn onto the pillowcase along a single main seam. The sewing of the hood to the pillowcase along a single seam creates features in the hood structure that are beneficial to the comfortable restraint of the user's head. Furthermore, the hood structure has a forward opening, a hood apex, and a rear seam that extends from the apex down to the single main seam. The rear seam also helps to reinforce the hood structure so it can better prevent unintentional movements of the user's head.

12 Claims, 7 Drawing Sheets

PILLOWCASE WITH INTEGRAL SECONDARY HOOD STRUCTURE

RELATED APPLICATIONS

This application claims the priority of provisional Patent Application No. 61/673,808, filed Jul. 20, 2012.

BACKGROUND OF THE INVENTION

1. Field of the Invention

In general, the present invention relates to the structure of pillowcases or pillows that are retained within pillowcases. More particularly, the present invention relates to pillowcases and pillows that contain a secondary hood that can be worn about the head.

2. Prior Art Description

By nature of human physiology, it is difficult for a person to sleep comfortably when seated upright in a chair. As a person falls asleep in a sitting position, the body initially holds the head straight and upright. However, as the body falls into a deeper sleep, the muscles of the head and neck involuntarily relax. This causes the head to tilt to the side or fall forward. Often this tilting of the head to the front or side occurs rapidly. Consequently, as the head tilts, it jerks to a stop as it reaches the anatomical limits of movement. The jerk often momentarily wakes the person, causing the person to again straighten their head and neck as they quickly fall back to sleep. The cycle of falling asleep, having the head fall to a jerk, and correcting the position of the head, can occur multiple times in a short period of time.

If a person sleeps with their head titled or fallen forward, or if a person sleeps and experiences multiple jerks, then that person has a significant likelihood of developing a neck strain or pinched nerve in the neck. This causes pain in the neck when a person wakes and tries to turn his/her head. The pain can last for days.

Healthy people are usually only forced to sleep in a sitting position due to environmental circumstances. For example, a person may be required to sleep on a long airplane flight or on a long car ride. People also commonly fall asleep in a sitting position by accident, such as when they fall asleep sitting on a couch watching television. However, some people have medical conditions that require them to sleep in a sitting position. Such medical conditions include people with severe sleep apnea, people with digestive track diseases, and the like.

Traditional pillows are designed to support the head of a person when that person is sleeping while lying flat in a bed. If such a pillow is used by a person sleeping in a sitting position, then the traditional pillow would only increase the likelihood that a person's head would tilt to the side or fall forward.

Neck pillows are often used to support a person's neck as they sleep in a sitting position. However, traditional neck pillows are typically U-shaped and support only the back and sides of the neck. Traditional neck pillows provide no support in front of the head. Consequently, the use of a traditional neck pillow does not prevent a person's head from falling forward as they sleep. In fact, due to the presence of a pillow behind the user's neck, the use of a neck pillow may actually increase the likelihood that a person's head will fall forward and a neck injury will occur.

The present invention attempts to create a better pillow for those who sleep in a sitting position by connecting a unique hood structure to the pillow. In the prior art, pillows have been invented that include hoods. Consider the traditional pillow types shown in U.S. Pat. No. 6,363,554 to Brown, and U.S. Pat. No. D270,320 to Smith. Also consider the neck pillow shown in U.S. Pat. No. 7,657,954 to Bunkers.

In the prior art pillow systems that are cited, hoods are connected to pillows. However, the purpose of the hood is merely to cover the eyes and/or ears of a sleeping person so they can sleep better in a loud or bright environment. The hoods used in such prior art systems are not designed to stabilize the user's head and physically inhibit the user's head from either tilting to the side or falling forward. As such, the prior art pillows that have hoods, if used, would not prevent the neck injuries that commonly afflict people who sleep in sitting positions.

A need therefore exists for a pillow and hood assembly that can be comfortably borne by a person sleeping in a sitting position, wherein the pillow and hood are specifically designed to deter movement of the head and neck during sleep. In this manner, a person can sleep more comfortably in a sitting position without having their heads tilt to the sides or fall forward during sleep. This need is met by the present invention as described and claimed below.

SUMMARY OF THE INVENTION

The present invention is a pillow assembly that utilizes a hood to inhibit the sudden jerking of the head that often occurs when a person falls asleep upright.

The pillow assembly utilizes a pillowcase having a top surface and a bottom surface. The pillowcase can be stuffed to become a pillow or can be used to cover a preexisting pillow.

A hood structure is sewn onto the pillowcase. The hood structure is sewn onto the pillowcase along a single main seam. The sewing of the hood to the pillowcase along a single seam creates features in the hood structure that are beneficial to the comfortable restraint of the user's head. Furthermore, the hood structure has a forward opening, a hood apex, and a rear seam that extends from the apex down to the single main seam. The rear seam also helps to reinforce the hood structure so it can better prevent unintentional movements of the user's head.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention pillowcase can be embodied in many ways, the embodiments illustrated show the pillowcase formed both as a rectangular pillowcase for a bed pillow and as a U-shaped pillowcase for a neck pillow. These embodiments are selected in order to set forth the two best modes contemplated for the invention. The illustrated embodiments, however, are merely exemplary and should not be considered a limitation when interpreting the scope of the appended claims.

Figure 1:
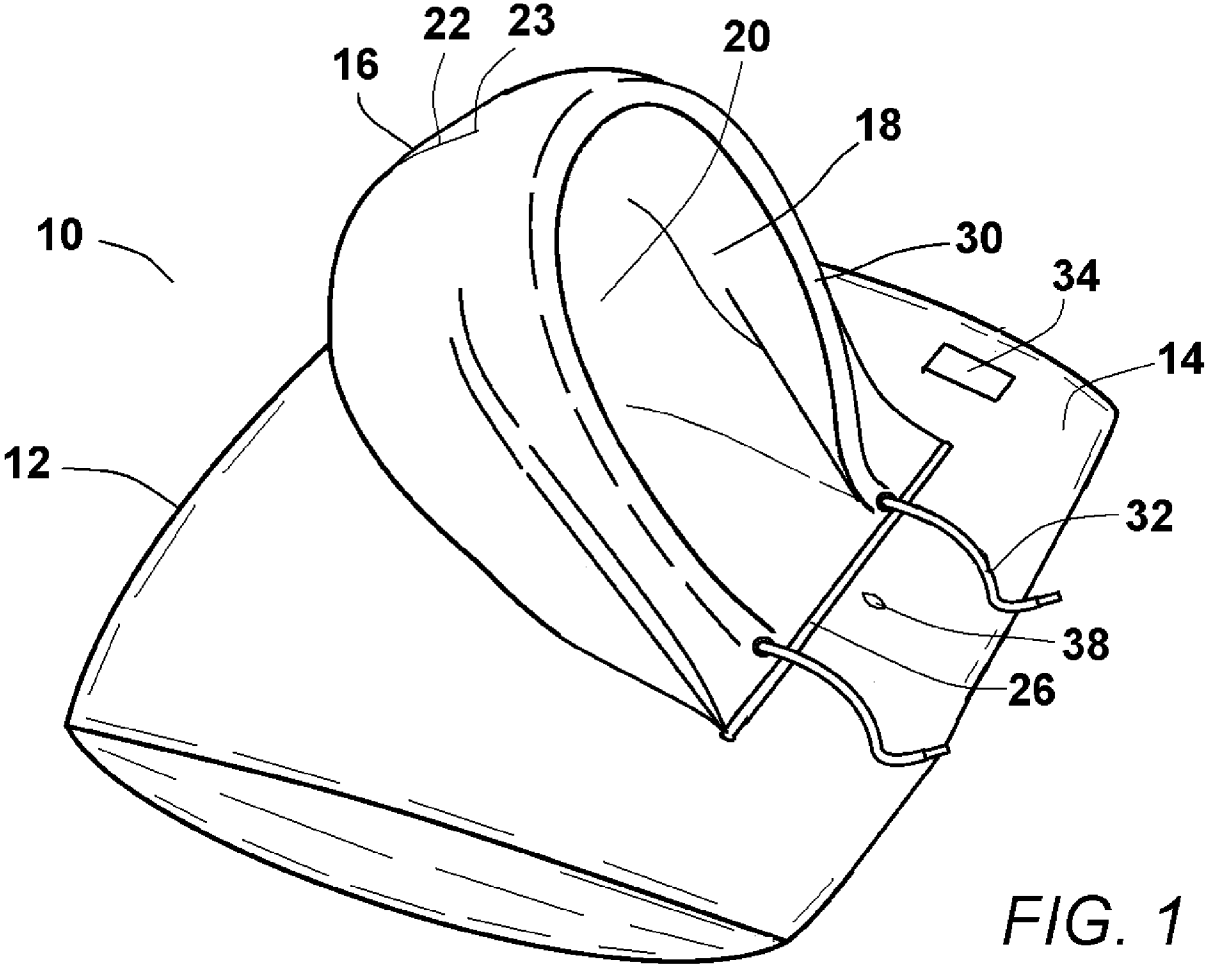
FIG. 1 is a perspective view of an exemplary embodiment of a pillow assembly containing a pillow covered by a pillowcase and hood assembly.
Figure 2:
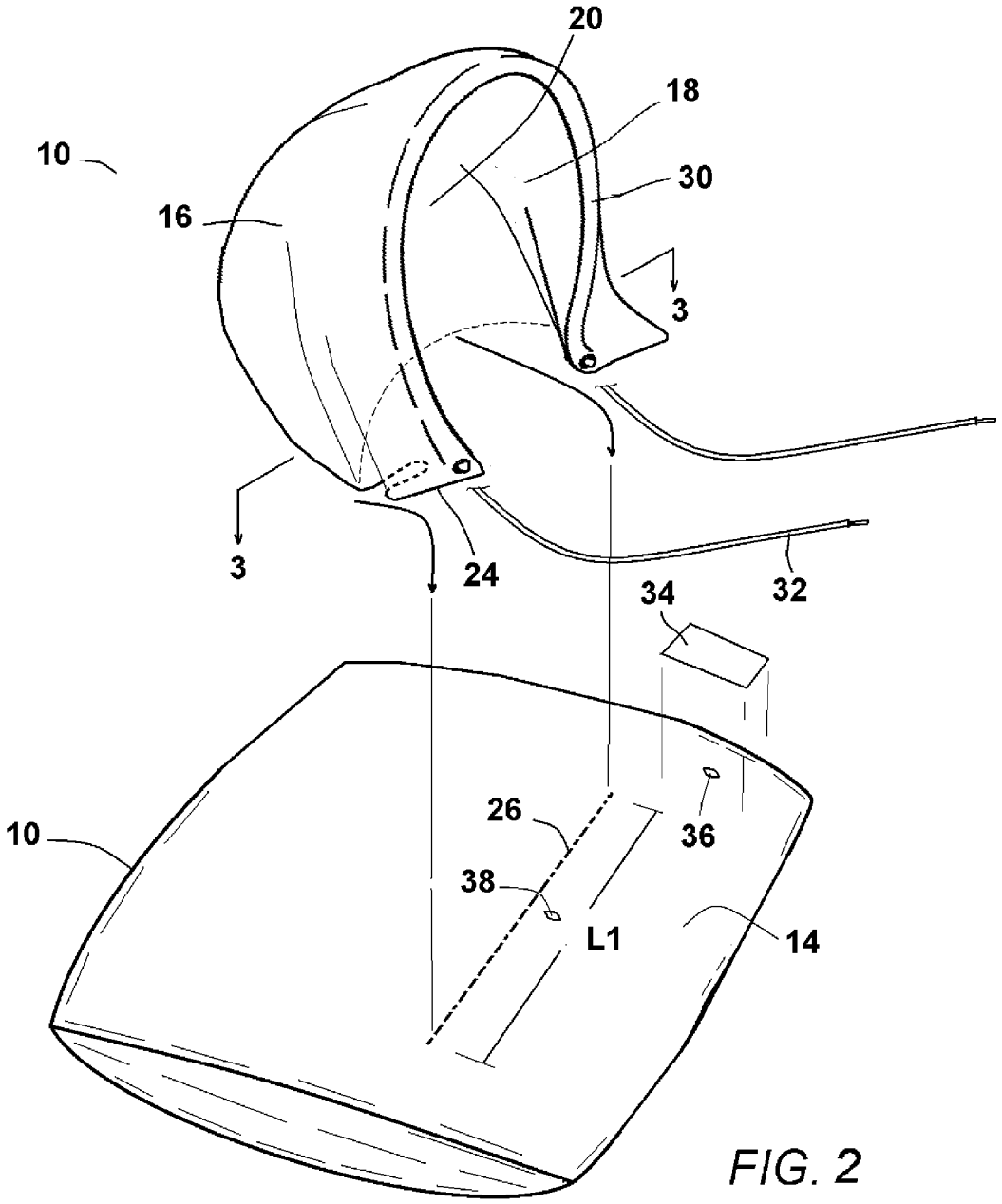
FIG. 2 is a exploded view of the exemplary embodiment of FIG. 1 showing the hood structure separated from the pillowcase.

Referring to FIG. 1 in conjunction with FIG. 2, a pillow assembly 10 is shown. The pillow assembly 10 includes a pillowcase 12 surrounding a traditional rectangular bed pillow (not shown). The pillowcase 10 has a top surface 14. A hood structure 16 is affixed to the top surface 14 of the pillowcase assembly 10. The hood structure 16 has a forward opening 18 that enables a person's head to enter an interior region 20 of the hood structure 16 while that person's head is also resting upon the pillow assembly 12 under the hood structure 16.

Figure 3:
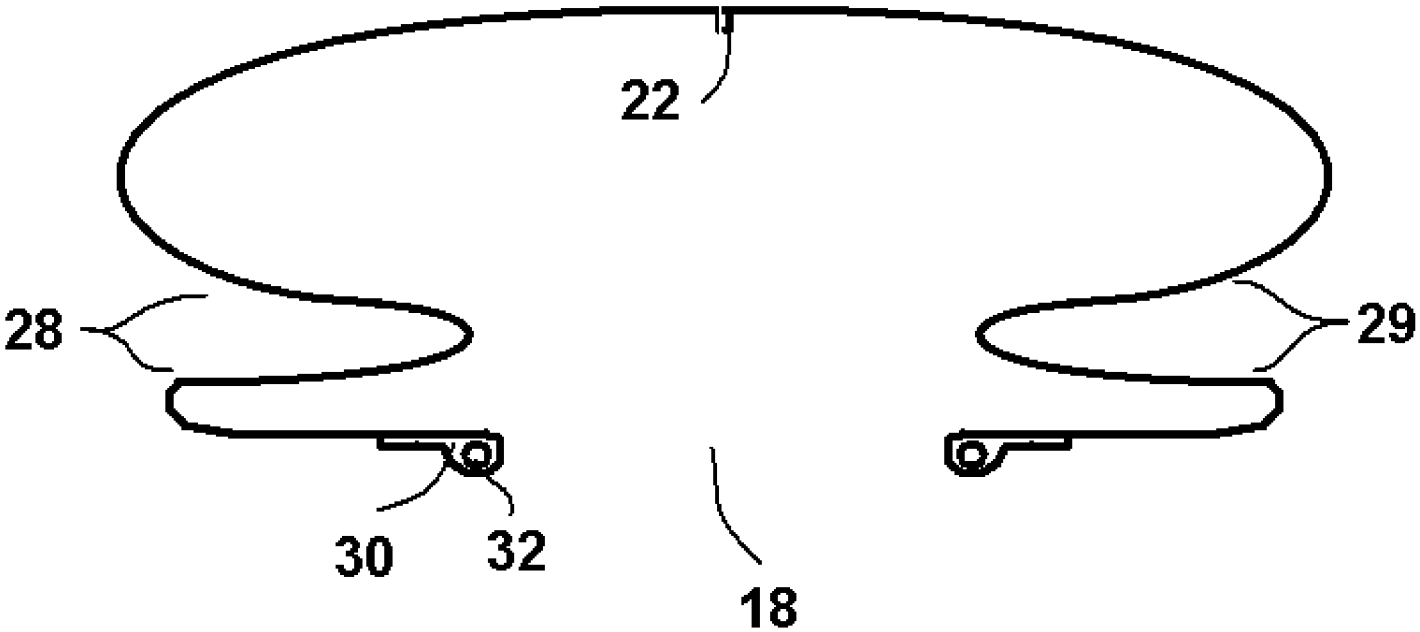
FIG. 3 is a cross-section view of the hood structure taken along section line 3-3 in FIG. 2.
Figure 4:
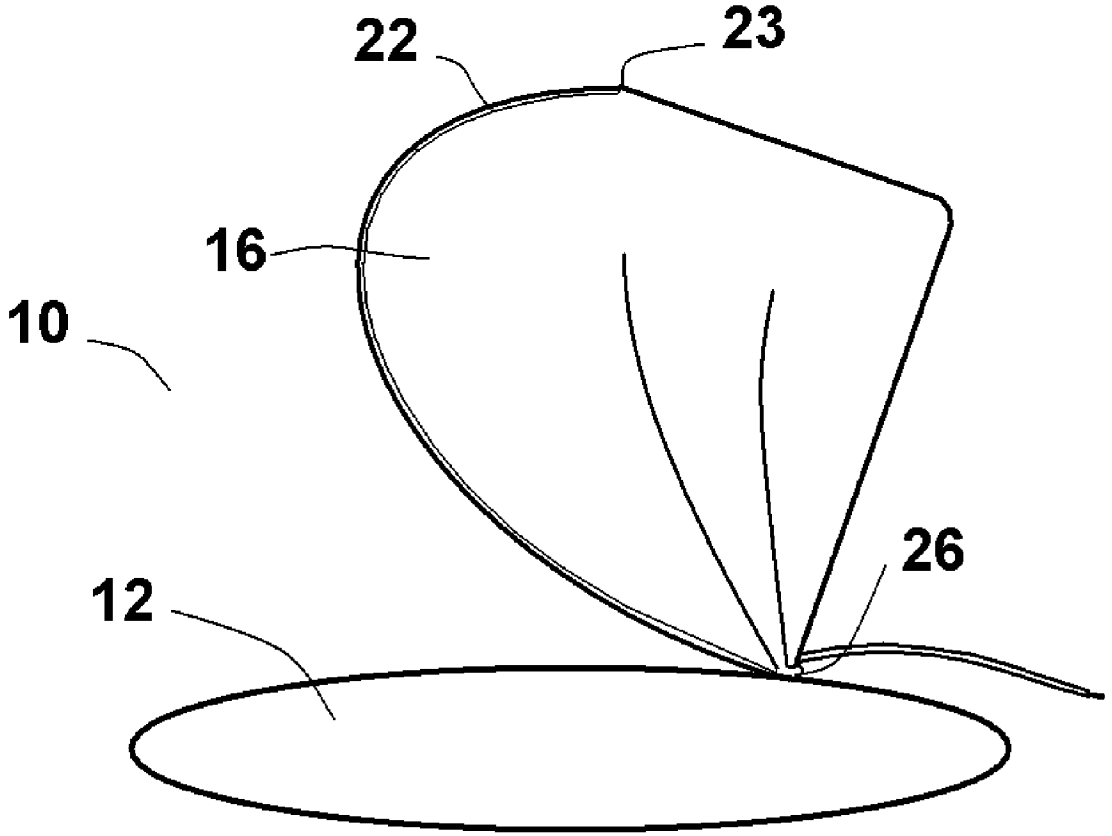
FIG. 4 is a side view of the exemplary embodiment.

Referring to FIG. 3 and FIG. 4 in conjunction with FIG. 1 and FIG. 2, it will be understood that the forward opening 18 of the hood structure 16 opens to the interior region 20 that is defined by the fabric of the hood structure 16. The interior region 20 of the hood structure 16 is large enough to receive the head of the average sized adult. The hood structure 16 is preferably made from a single piece of fabric that curves about a person's head. However, the fabric is partially slit and sewn back together along a vertical seam 22 in the rear surface of the hood structure 16, to tailor a curved shape to the rear surface of the hood structure 16. The vertical seam 22 serves an important purpose that will later be explained.

The hood structure 16 is affixed to the top surface 14 of the pillowcase 12 in a unique manner. The hood structure 16 has a long bottom edge 24. The entire bottom edge 24 of the hood structure 16 is gathered and sewn to the underlying pillowcase 12 along a single straight main seam 26. In order to gather the entire bottom edge 24 of the hood structure 16 into a single seam, two large folded pleats 28, 29 must be formed in the fabric of the hood structure 16, one on either side of the forward opening 18. The main seam 26 has an overall length L1. The forward opening 18 of the hood structure 16 is centered in the middle of the main seam 26. The forward opening 18 has a length along the main seam 26 that is about half the length L1 of the overall main seam 26. It will therefore be understood that the bottoms of the two large pleats 28, 29 within the main seam 26 are significant and account for the remaining half the length L1 of the main seam 26.

The large folded pleats 28, 29 extend on either side of the forward opening 18. The folded pleats 28, 29 serve as structure reinforcement and inhibit the hood structure 16 from moving side to side while supporting a person's head. The hood structure 16 is further reinforced by the presence of a drawstring hem 30. A drawstring hem 30 is sewn long the edge of the forward opening 18. The drawstring hem 30 holds a drawstring 32. When the drawstring 32 is pulled, the size of the forward opening 18 can be selectively decreased. Furthermore, the drawstring hem 30 extends into the main seam 26 at both ends of the drawstring hem 30. This creates another structural reinforcement that surrounds the periphery of the forward opening 18.

As has been previously mentioned, there is a vertical seam 22 in the rear of the hood structure 16. The vertical seam 22 extends upwardly from the main seam 26. However, the vertical seam 22 does not extend all the way to the forward opening 18. Rather, the vertical seam 22 is the result of a tailored taper that provides the hood structure 16 with a curved shape. The vertical seam 22 extends from the maim seam 26, up the rear of the hood structure 16, to the apex 23 of the hood structure 16. The vertical seam 22 is a double sewn seam that provides structural integrity to the rear of the hood structure 16. This prevents the rear of the hood structure 16 from stretching when it is supporting a person's head.

A pocket 34 is formed in the pillowcase 12 at a position to one side of the hood structure 16. Inside the pocket 34 is a first buttonhole 36 that passes through the top surface 14 of the pillowcase 12. Additionally, a second buttonhole 38 is formed in the top surface 14 of the pillowcase 12 just below the center of the main seam 26. The two buttonholes 36, 38 enable wires to extend from inside the pocket 34 to the hood structure 16 inside the pillowcase 12. In this manner, a person can place an electronic music player within the pocket 34 and listen to the music using headphones with the headphone wires extending from the first buttonhole 36 to the second buttonhole 38 inside the pillowcase 12.

Figure 5:
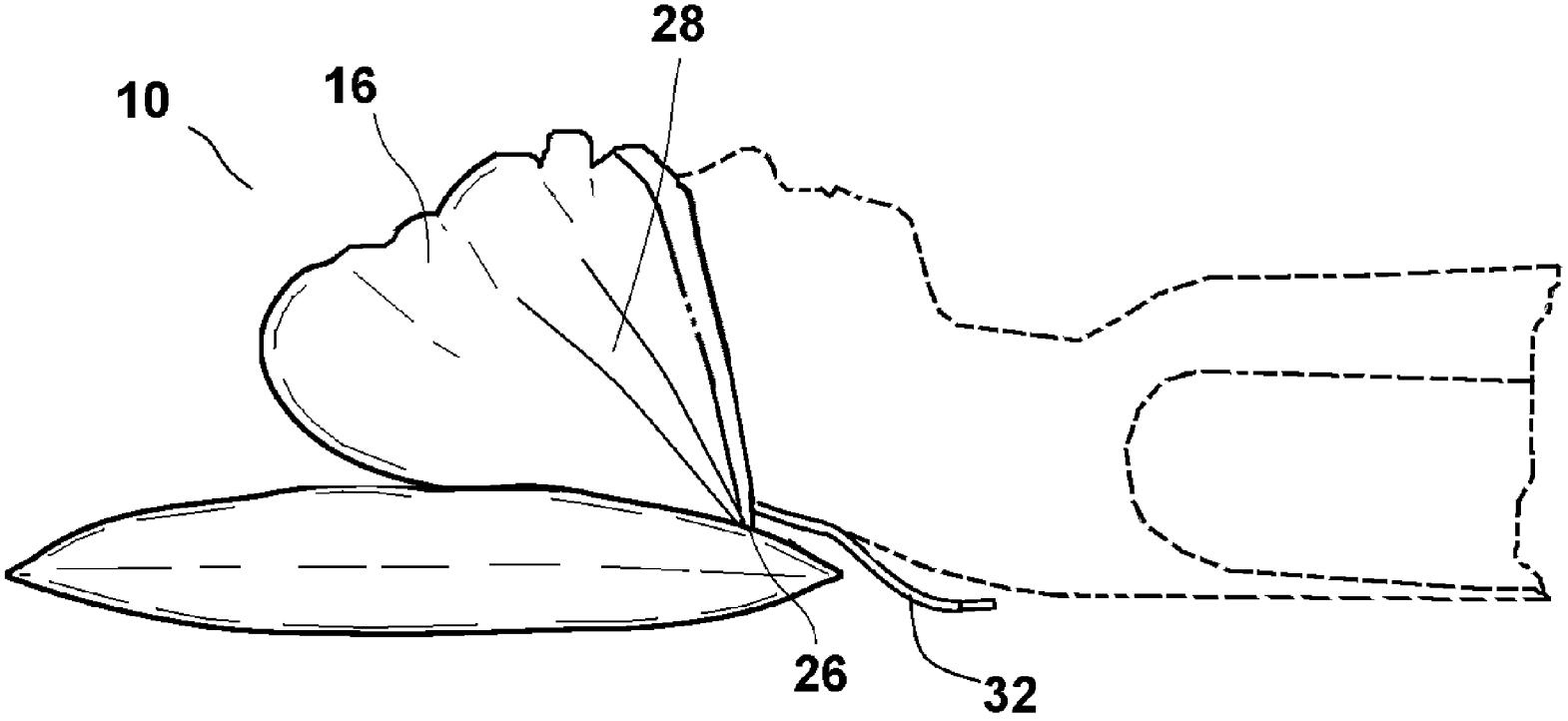
FIG. 5 is a side view of the embodiment of FIG. 1 shown with the hood structure drawn over the head of a person resting upon the pillow assembly.

Referring to FIG. 5 in conjunction with FIG. 1, it will be understood that the hood structure 16 is sized to cover the head of an individual, down to the eyes of that individual. When a person is resting upon the pillow assembly 10 and that person's head is in the hood structure 16, the drawstring 32 can be pulled. When the drawstring 32 is pulled, the hood structure 16 tightens over the head of the resting person and covers the eyes and ears of that resting person. The hood structure 16 does not cover the nose or mouth of the resting person and therefore does not obstruct breathing. However, by conforming to the head, the folded pleats 28, 29 on the sides of the hood structure 16 pull taut. This inhibits a person from moving their head from side to side when laying flat.

Figure 6:
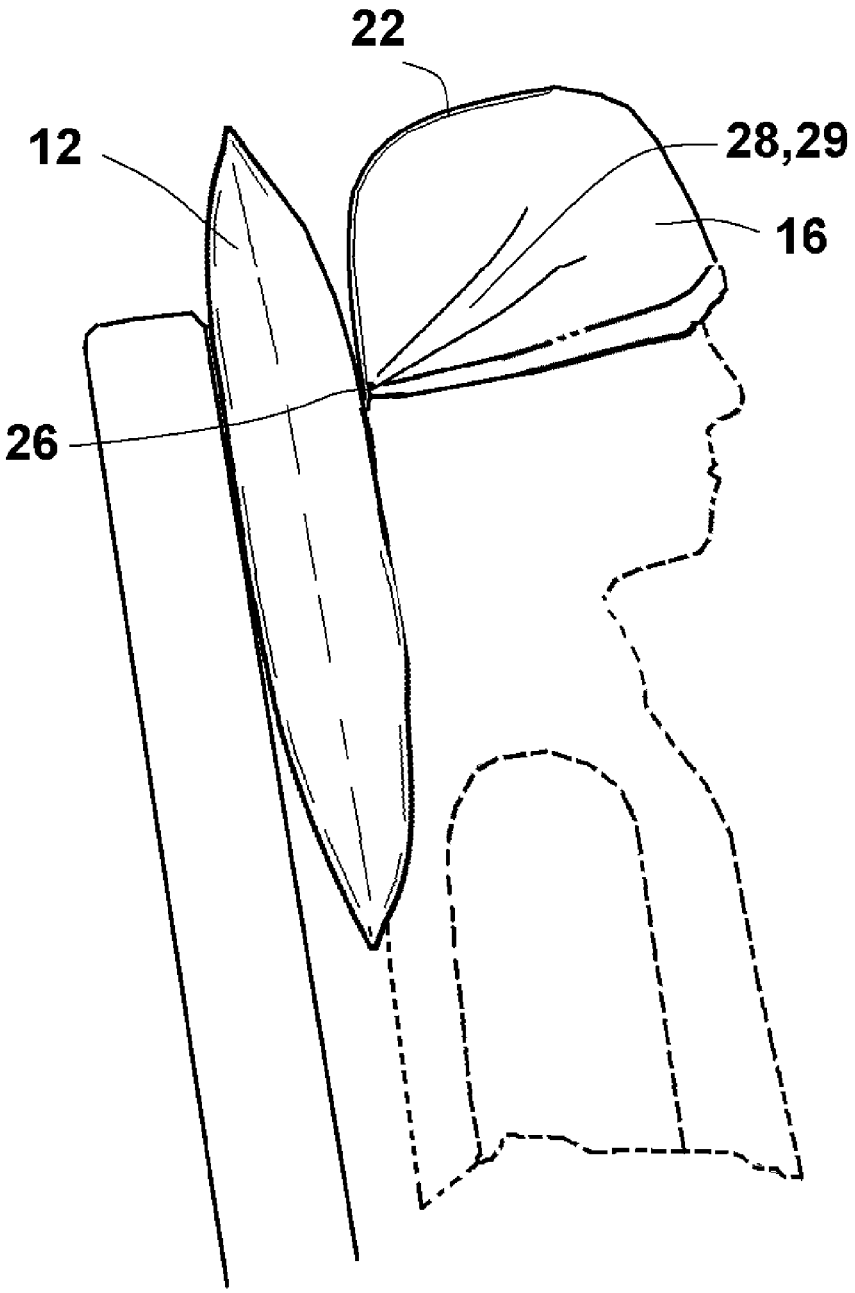
FIG. 6 is a side view of the embodiment of FIG. 1 shown with the hood structure drawn over the head of a person seated upright in a chair.

Referring to FIG. 6, the pillow assembly 10 is shown covering and supporting the head of a person sitting upright in a seat. Since the hood structure 16 attaches to the pillowcase 12 with only one straight main seam 26, the main seam 26 can be used as a hinge joint. This enables the pillowcase 12 to be rotated away from the hood structure 16. The pillowcase 12 and the pillow it supports can therefore be positioned behind the back of a person sitting upright. With the pillowcase 12 in this position, the hood structure 16 can be rotated to a position where it covers the person's head. When in this position, the side folded pleats 28, 29 and the rear vertical seam 22 are pulled taut. Thus, once the hood structure 16 is tightened around the head with a drawstring 32, the folded pleats 28, 29 prevent the head from falling to the side. Likewise, the vertical seam 22 prevents the head from falling forward. A person can therefore rest comfortably, with the head secured, and both his/her neck and back properly supported.

In the embodiment of FIGS. 1 through 6, the pillowcase 12 is for use with a simple square bed pillow. It will be understood that few people will travel on airplanes, trains and the like with bed pillows. Rather, neck pillows are used. The technical improvements previously described for use with a cover for a rectangular pillow can be adapted for use with a cover for a neck pillow, as is explained below.

Figure 7:
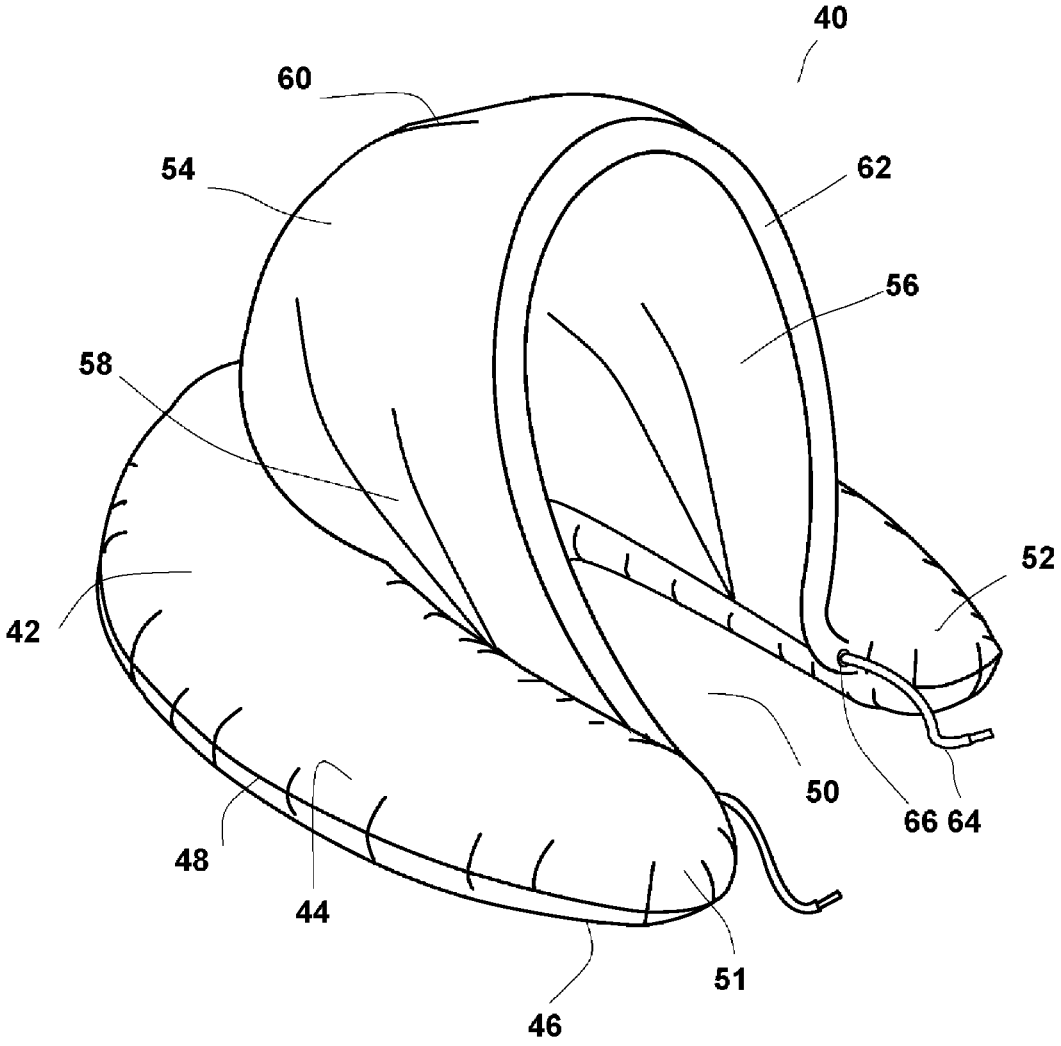
FIG. 7 is a perspective view of an alternate embodiment of the present invention.

Referring to FIG. 7, a neck pillow assembly 40 is shown. The neck pillow assembly 40 includes a U-shaped pillowcase 42 in which a U-shaped pillow or padding is held. The pillowcase 42 has a top surface 44 and a bottom surface 46. A central seam 48 is formed around the periphery of the pillowcase 42 halfway between the top surface 44 and the bottom surface 46. Since the pillowcase 42 is U-shaped, it defines a central area 50 between the opposing arms 51, 52.

A hood structure 54 is sewn to the central seam 48 around the central area 50. The hood structure 54 is the same as was previously described. The hood structure 54 includes a forward opening 56, side pleats 58 and a vertical rear seam 60. A drawstring hem 62 extends around the forward opening 56. The drawstring hem 62, the side pleats 58, and the vertical rear seam 60 all have bottom edges that are sewn directly to the pillowcase 42 along the central seam 48.

A drawstring 64 is present within the drawstring hem 62. The drawstring 64 exits the drawstring hem 62 at two holes 66 on opposite sides of the forward opening 56. Since the hood structure 54 is sewn to the central seam 48, the U-shaped pillow or padding within the U-shaped pillowcase 42 extends partially up the hood structure 54. This prevents a person's head inside the hood structure 54 from tilting to the side or backwards. A person's head is prevented from tilting forward primarily by two features. First, the vertical rear seam 60 reinforces the rear of the hood structure 54 and prevents the hood structure 54 from stretching forward. Second, the placement of the drawstring holes 66 in the drawstring hem 62 is such that the arms 51, 52 of the U-shaped pillowcase 42 are pulled toward each other as the drawstring 64 is pulled taut. As the ends of the pillowcase 42 move toward each other, they converge toward the chin of any person resting in the neck pillow assembly 40. Thus, a person's head is inhibited from falling forward, should that person fall asleep.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. An assembly comprising:

a pillowcase having a top surface and a bottom surface;

a hood structure made from a single piece of fabric having a bottom edge, wherein said bottom edge is gathered and sewn to said top surface of said pillowcase only along a single straight main seam, therein providing said hood structure with an interior region under a hood apex, that is accessible through a forward opening, and wherein said hood structure contains a first folded pleat on one side of said forward opening and a second folded pleat on an opposite side of said forward opening, wherein said first pleat and said second pleat each have a bottom sewn into said straight main seam.

2. The assembly according to claim 1, wherein said straight main seam has a first length and said forward opening extends a second length along said straight main seam, wherein said second length is generally half of said first length.

3. The assembly according to claim 1, wherein said forward opening has an edge and said assembly further includes a drawstring hem that extends along said edge, said drawstring hem both beginning and ending on said straight main seam.

4. The assembly according to claim 3, wherein a drawstring extends through said drawstring hem.

5. The assembly according to claim 1, further including a pocket on said pillowcase, wherein a first hole extends through said top surface of said pillowcase within said pocket.

6. The assembly according to claim 5, wherein a second hole extends through said top surface of said pillowcase proximate said straight main seam.

7. An assembly comprising:

a pillowcase having a top surface;

a hood structure having a bottom edge that is gathered and sewn to said pillowcase only along a single straight main seam, said hood structure having a forward opening, an hood apex, and folded pleats on either side of said forward opening, wherein said straight main seam has a first length and said forward opening extends a second length along said straight main seam, wherein said second length is generally half of said first length.

8. The assembly according to claim 7, further including a pocket disposed on said top surface of said pillowcase, wherein a first hole extends through said top surface of said pillowcase within said pocket.

9. The assembly according to claim 8, wherein a second hole extends through said top surface of said pillowcase proximate said straight main seam.

10. The assembly according to claim 7, further including a rear seam that extends from said apex down to said single main seam, wherein said rear seam bisects said straight main seam at a perpendicular.

11. The assembly according to claim 7, wherein said forward opening has an edge and said assembly further includes a drawstring hem that extends along said edge, said drawstring hem both beginning and ending on said straight main seam.

12. An assembly comprising:

a pillowcase having a top surface and a bottom surface;

a hood structure sewn to said pillowcase along a single main seam, said hood structure having a forward opening, a hood apex, and a rear seam that extends from said apex down to said single main seam;

a pocket on said pillowcase, wherein a first hole extends through said top surface of said pillowcase within said pocket.

* * * * *